US005212359A

United States Patent [19]

Morganti

[11] Patent Number: 5,212,359

[45] Date of Patent: May 18, 1993

[54] MULTIPLE INTERFACE SAFETY SWITCH ACTUATING MECHANISM

[75] Inventor: Terry N. Morganti, Brockport, N.Y.

[73] Assignee: Eastman Kodak Company, Rochester, N.Y.

[21] Appl. No.: 829,637

[22] Filed: Feb. 3, 1992

[51] Int. Cl.[5] ..... H01H 3/16

[52] U.S. Cl. ..... 200/61.69

[58] Field of Search ..... 200/61.62, 61.69, 332.1, 200/332.2, 332, 334

[56] References Cited

U.S. PATENT DOCUMENTS

| | | | |
|---|---|---|---|
| 2,408,213 | 9/1946 | Huber | 200/61.69 |
| 3,428,766 | 2/1969 | Kauffman | 200/61.69 |
| 3,815,990 | 6/1974 | Newcomb et al. | 355/13 |
| 3,829,644 | 8/1974 | Annettoni | 200/332.1 |
| 3,881,077 | 4/1975 | Piber | 200/61.69 |
| 3,887,777 | 6/1975 | Nishino | 200/61.69 |
| 4,300,025 | 11/1981 | Prada | 200/61.69 |
| 4,707,684 | 11/1987 | Janke et al. | 340/530 |
| 4,891,626 | 1/1990 | Neuman | 340/547 |

*Primary Examiner*—J. R. Scott
*Attorney, Agent, or Firm*—J. Gary Mohr

[57] ABSTRACT

A multiple interface safety switch actuating mechanism, operable by actuators on the doors of a cabinet, is provided. The switch actuating mechanism, through abutting contact with a biased shaft activated switch, enables an apparatus, contained within the cabinet, when the doors of the cabinet are closed and disables the apparatus, contained within the cabinet, when a door of the cabinet is open. The switch actuating mechanism is maintained in a first position when both doors are open, in a second position upon the closing of one door and in a third position upon the closing of both doors. Accidental activation of the switch actuating mechanism is prevented by a slotted plate mounted in front of the switch actuating mechanism to preclude other than the door actuators from activating the switch actuating mechanism.

7 Claims, 6 Drawing Sheets

Fig.10
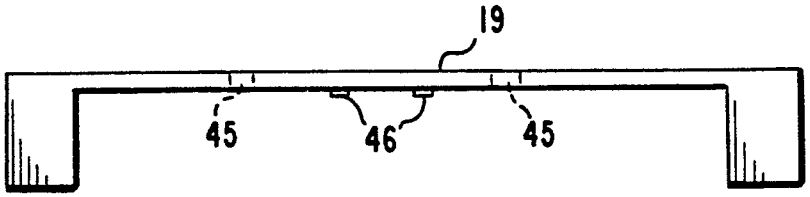
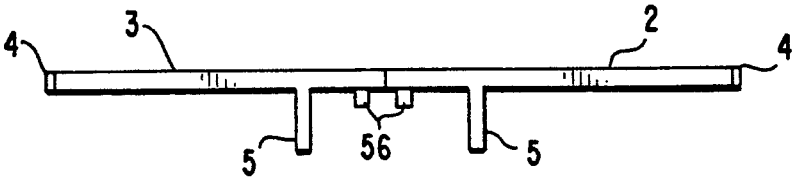
Fig.11
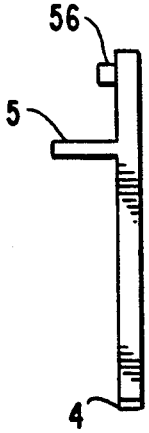
Fig.12
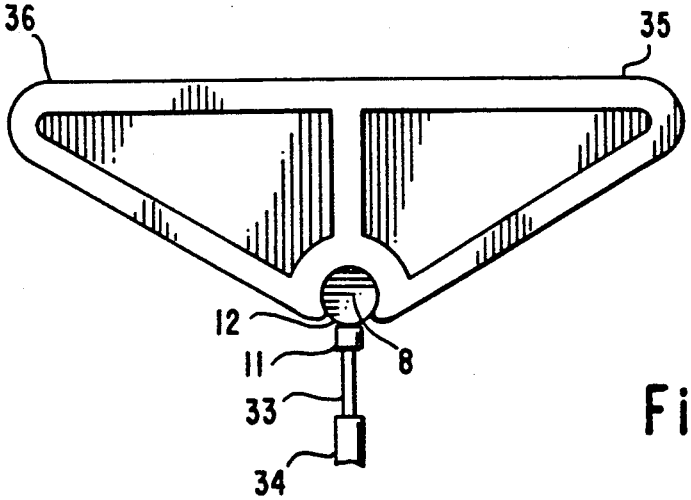
Fig.15

Fig.13
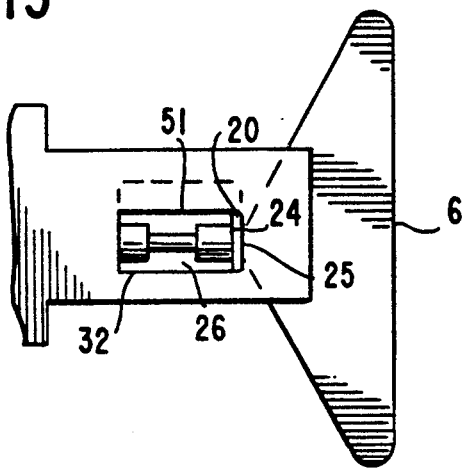
Fig.16
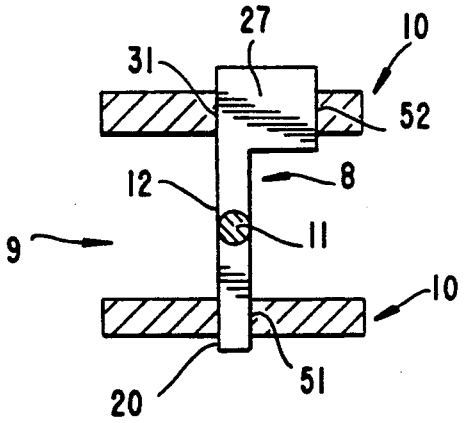
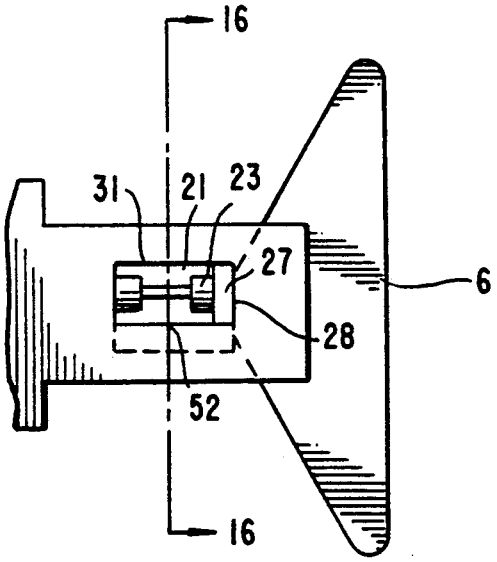
Fig.14

MULTIPLE INTERFACE SAFETY SWITCH ACTUATING MECHANISM

FIELD OF THE INVENTION

The present invention generally relates to electrical switch actuating mechanisms and more specifically, to a multiple interface safety switch actuating mechanism particularly adapted for use with a cabinet having double doors.

BACKGROUND OF THE INVENTION

Door activated switch mechanisms are particularly useful for a reproduction apparatus, such as a copier, utilizing an electrophotographic process. In such apparatus it is common practice, for safety reasons, to disable the electrical circuitry of the apparatus such that the apparatus is inoperable when one or more doors, of the cabinet containing said apparatus, are open. By providing such a switch actuating mechanism, an operator is protected from exposure to the high voltages and intense illumination associated with the operation of the reproduction apparatus.

While U.S. Pat. No 2,408,213 and U.S. Pat. No. 4,300,025 disclose switch activators for multiple doors, in their respective fields, that pivot and slide, they do not provide a simple and reliable switch actuating mechanism that prevents accidental operation of the apparatus when one or more doors, of the cabinet containing the apparatus, are open.

SUMMARY OF THE INVENTION

It is an object of the present invention to provide a simple, reliable and easy to assemble multiple interface safety switch actuating mechanism that disables an apparatus and prevents accidental contact with the switch actuating mechanism when one or more doors, of a cabinet containing said apparatus, are open.

The above objects are accomplished by a multiple interface safety switch actuating mechanism, operable by door actuators of a double door cabinet, for moving a normally biased open switch mechanism between its positional stations as the doors of the cabinet are opened and closed. The mechanism has a cabinet mount housing for mounting an actuator housing containing a pivotal and slidable means that pivots and slides within the actuator housing. Mounting means mount the pivotal and slidable means, in the actuator housing, so that the mounting means abuts the switch mechanism to activate the positional stations, in response to the slidable movement of the pivotal and slidable means. Guide means guide the movement of the mounting means as the mounting means responds to the movement of the pivotal and slidable means. Reception means are provided for receiving the door actuators that impart and control the pivotal and sliding movement of the pivotal and slidable means as the doors are opened and closed.

The invention, and its objects and advantages, will become more apparent in the detailed description of the preferred embodiment presented below.

BRIEF DESCRIPTION OF THE DRAWINGS

FIG. 10 is a top view of the striker plate, for the multiple interface safety switch actuating mechanism, in accordance with the present invention, FIG. 11 is a top view of the cabinet doors and door actuators, for the multiple interface safety switch actuating mechanism, in accordance with the present invention, FIG. 12 is a side view of the door actuators, for the multiple interface safety switch actuating mechanism, in accordance with the present invention, FIG. 13 is a partial bottom view of the multiple interface safety switch actuating mechanism in accordance with the present invention, FIG. 14 is a partial top view of the multiple interface safety switch actuating mechanism in accordance with the present invention, FIG. 15 is a top view of the pivotal switch element showing the abutting contact between the pivot pin and the micro-switch actuator, in accordance with the present invention and FIG. 16 is a sectional view through section line 16—16 of FIG. 14 with the pivotal switch element removed.

DESCRIPTION OF THE PREFERRED EMBODIMENT

Figure 1:
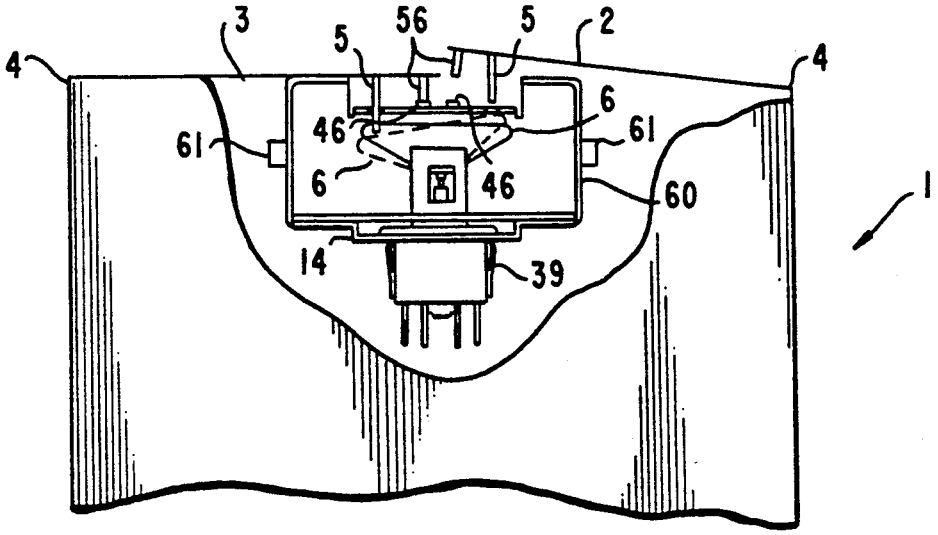
FIG. 1 is a fragmentary view of the reproduction apparatus, partially cut away to show the mounting location, housing and position of the multiple interface safety switch actuating mechanism, in accordance with the invention, when one door is closed.

While the present invention is susceptible to embodiments of many different forms, there is shown in the drawings and hereinafter described, in detail, a preferred embodiment of the invention. It should be understood, however, that the present disclosure is to be considered as an exemplification of the principles of the invention and is not intended to limit the invention to the embodiments illustrated and/or described.

For ease of description, the mechanism will be described in its normal operational position, and terms such as upper, lower, horizontal, etc . . . , will be used with reference to normal operating positions. It will be understood, however, that this mechanism may be manufactured, stored, transported and sold in an orientation other than the normal operational positions described.

In describing the preferred embodiment of the present invention, reference is made to the drawings, wherein like numerals indicate like parts and structural features in the various views, diagrams and drawings.

Figure 8:
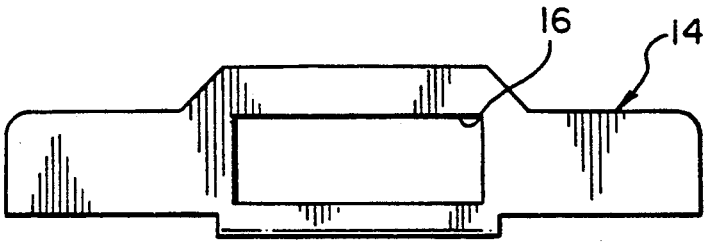
FIG. 8 is a front view of the mounting bracket, for mounting the multiple interface safety switch actuating mechanism, in accordance with the present invention.
Figure 9:
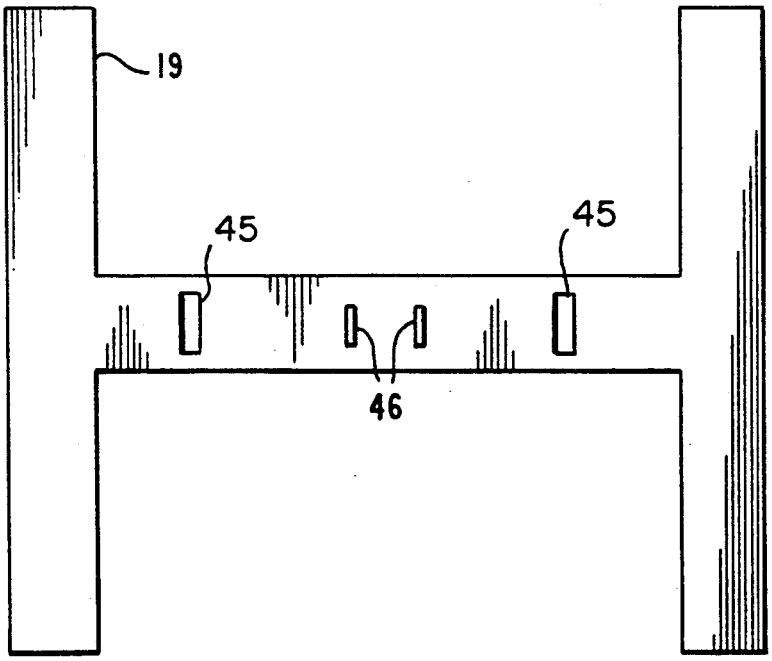
FIG. 9 is a front view of a striker plate, for the multiple interface safety switch actuating mechanism, in accordance with the present invention.

Referring now to the drawings, and initially to FIG. 1, there is illustrated a cabinet 1 for housing various items, such as the internal workings of a reproduction apparatus. Cabinet 1 has at least two doors, door 2 and door 3, which pivot about pivot points 4, of cabinet 1, as door 2 and door 3 are opened and closed. Cabinet 1 also contains a cabinet mount housing 60 mounted within cabinet 1 by supports 61 which mount, in a manner known in the art, but not shown, to the inside floor and inside top of cabinet 1. Cabinet mount housing 60 has secured to it a switch mounting bracket 14, see FIGS. 7 and 8, and a striker plate 19, with striker plate 19 containing slots 45 and magnets 46, see FIGS. 9 and 10.

Figure 4:
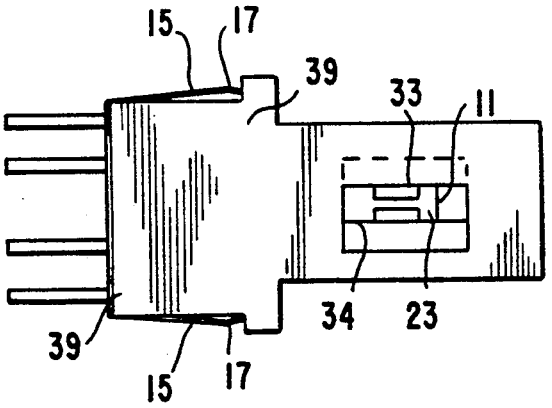
Fig.4 PRIOR ART
FIG. 4 is a top view of a prior art bias shaft activated micro-switch and actuator housing.

As further shown in FIG. 1 doors 2 and 3, of cabinet 1, have mating edges 56, see FIGS. 11 and 12, which mate with magnets 46, of striker plate 19, upon doors 2 and 3 being closed. Magnets 46 maintain doors 2 and 3, once closed, in their closed position until an operator opens said doors. In addition, both doors 2 and 3 have actuators 5, such as rods, see FIGS. 11 and 12, with each actuator 5 mounted for contact with a pivotal switch element 6, through slots 45, of striker plate 19, when either door 2 or 3, associated with said actuator, is closed. In response to door actuators 5, engaging or disengaging pivotal switch element 6, pivotal switch element 6 operates through a known switch device 39, such as a normally biased open shaft activated three station micro-switch of the type manufactured by MICRO SWITCH of Freeport, Ill. under part number 975201, see FIG. 4, to enable the electrical circuits of the reproduction apparatus upon closing of both doors 2 and 3 and to disable said electrical circuits, of the reproduction apparatus, upon opening of either or both doors 2 and 3. Since pivotal switch element 6 is mounted and enclosed within cabinet mount housing 60 and behind striker plate 19, with access to pivotal switch element 6 only through slots 45, of striker plate 19, accidental activation of pivotal switch element 6 by contact or brushing against the reproduction apparatus when the doors are open, is prevented.

Figure 2:
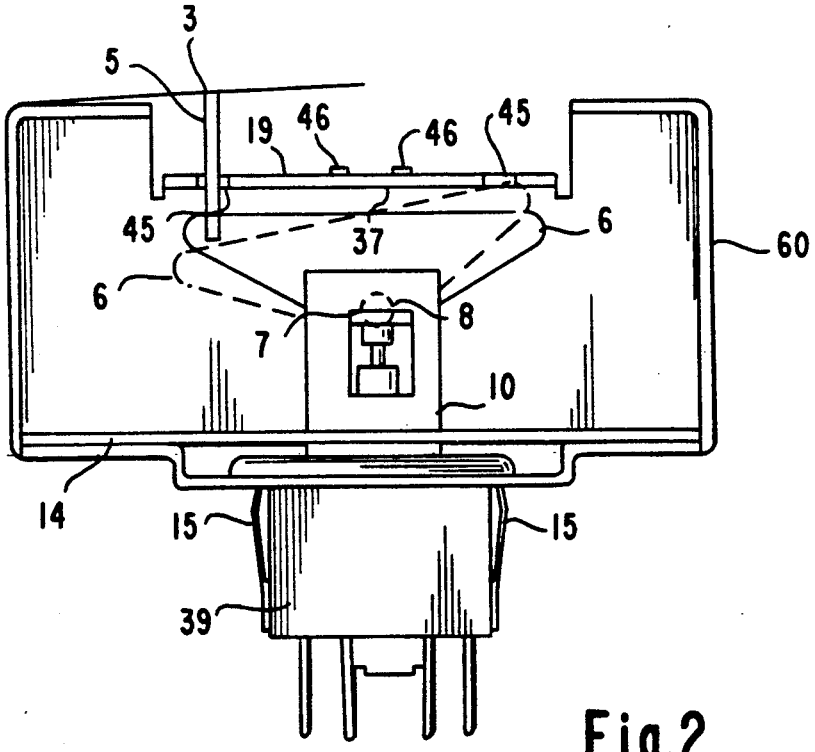
FIG. 2 is a schematic top view of the multiple interface safety switch actuating mechanism and its housing, in accordance with the present invention, when one door is partially closed.
Figure 7:
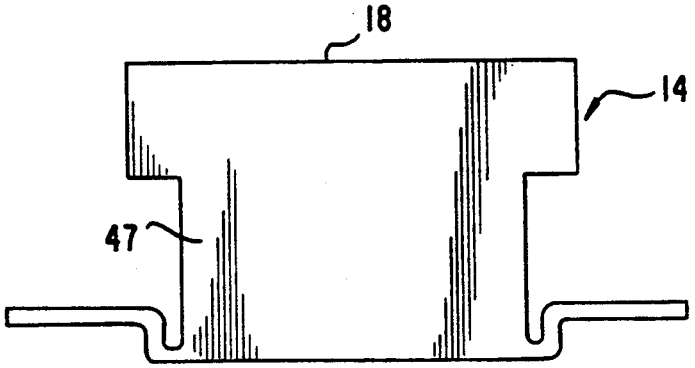
FIG. 7 is a top view of a mounting bracket, for mounting the multiple interface safety switch actuating mechanism, in accordance with the present invention.

As shown in FIG. 2, micro-switch 39 and an attached actuator housing 10 are mounted in switch mounting bracket 14, said bracket being depicted in FIG. 7. Micro-switch 39 is mounted, in switch mounting bracket 14, by squeezing and then inserting flexible retainers 15, of micro-switch 39, see FIG. 4, through an opening 16 of switch mounting bracket 14, see FIG. 8. Since the space between the far ends 17, of flexible retainers 15, is greater than opening 16, of switch mounting bracket 14, micro-switch 39 is maintained firmly within switch mounting bracket 14. With this type of mounting, if one needed to replace or repair micro-switch 39, one only has to squeeze flexible retainers 15 and remove bias shaft activated micro-switch 39 from switch mounting bracket 14.

In FIGS. 1 and 2, pivotal switch element 6, is portrayed, by solid lines, in the position it occupies when both doors 2 and 3 are open, and micro-switch 39 is at its first positional station; by dotted lines, in FIG. 1, in the position it occupies when door 2 is open and door 3 is closed, and micro-switch 39 is at its second positional station; and in dotted lines, in FIG. 2, in the position it occupies when door 2 is open and door 3 is partially closed and micro-switch 39 is between its first and second positional stations.

Figure 3:
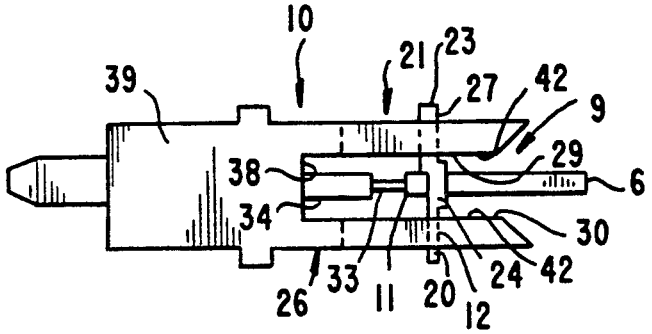
FIG. 3 is a schematic side view of the multiple interface safety switch actuating mechanism mounted in an actuator housing of a known bias shaft activated micro-switch.
Figure 5:
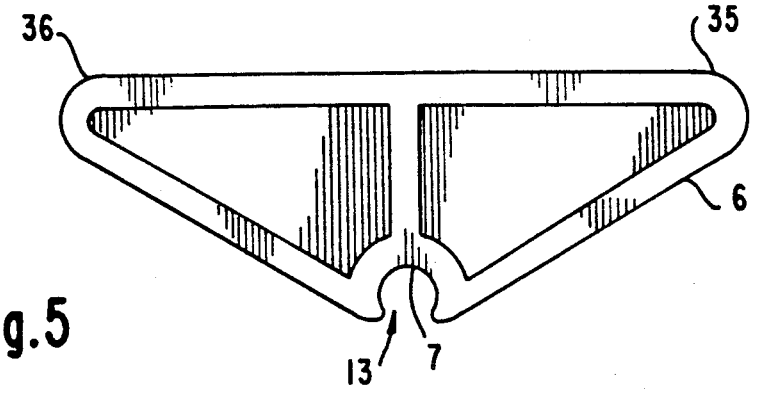
FIG. 5 is a top view of a pivotal switch element in accordance with the present invention.
Figure 6:
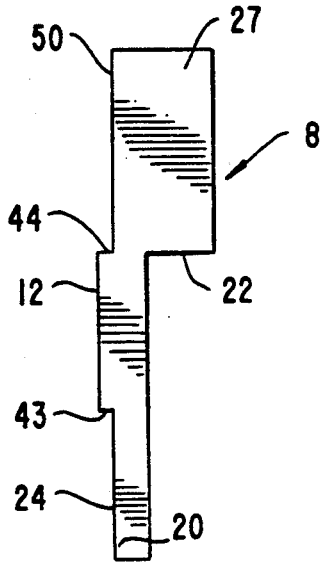
FIG. 6 is a front view of the pivot pin, for securing the pivotal switch element, in accordance with the present invention.

For securing pivotal switch element 6, in actuator housing 10, as shown in FIG. 3, pivotal switch element 6 has a pivot pin retainer housing 7, as shown in FIG. 5, in which an eccentric pivot pin 8, see FIG. 6, is inserted to maintain pivotal switch element 6 within a slidable slot 9 of actuator housing 10. As shown in FIGS. 5 and 6, the diameter of a cylindrical surface 12, of pivot pin 8, is just slightly smaller than the diameter of retainer housing 7, of pivotal switch element 6, but larger than opening 13 of pivotal switch element 6. This particular sizing of retainer housing 7 and cylindrical surface 12 allows pivotal movement, of pivotal switch element 6, about pivot pin 8 and precludes pivot pin 8 from becoming disengaged from pivotal switch element 6 through opening 13. While retainer housing 7 could be completely enclosed, to completely enclose retainer housing 7, when molding a piece such as pivotal switch element 6, it would require substantial material around the enclosure to maintain its structural integrity. This would necessitate making pivotal switch element 6 bigger. Therefore, to maximize the size of retainer housing 7, so that it may accommodate cylindrical surface 12, of a sufficiently sound structural diameter, without increasing the size or compromising the integrity of pivotal switch element 6, opening 13 is part of retainer housing 7. In addition, as shown in FIG. 15, because of opening 13, in retainer housing 7, a bias micro-switch actuator 11 only imparts its biasing force to pivotal switch element 6, through abutting contact with cylindrical surface 12 of pivot pin 8. This prevents any jamming, of the pivotal movement of pivotal switch element 6, about pivot pin 8, which might result from the biasing force of micro-switch actuator 11 being applied directly to pivotal switch element 6. This abutting contact of pivot pin 8, with biased micro-switch actuator 11, however, maintains interaction between micro-switch actuator 11 and pivotal switch element 6, so that any sliding motion of pivotal switch element 6, is conveyed to switch actuator 11 through the abutting contact with pivot pin 8.

Pivot pin 8, as shown in FIG. 6, is positioned, as shown in FIGS. 3, 13 and 14, within rectangular slots 21 and 26, and it secures pivotal switch element 6, within slidable slot 9, see FIG. 3, for pivotal and slidable movement. Locating pivot pin 8, within slots 21 and 26, so that pivotal switch element 6, will freely pivot and slide is assured by having flat section 24, of pivot pin 8, adjacent to edge 25 and a side portion 20, of flat section 24, in slidable contact with edge 51, see FIG. 16, of rectangular slot 26; shoulder 22, of pivot pin 8, in abutting contact with a surface 23 of micro-switch actuator 11; cylindrical surface 12 inserted through retainer housing 7 and in abutting contact with biased micro-switch actuator 11 and top rectangular portion 27, of pivot pin 8, adjacent to edge 28 and in slidable contact with both edges 31 and 52, see FIG. 16, of rectangular slot 21. By having rectangular portion 27, of pivot pin 8, in sliding contact with both edges 31 and 52 of rectangular slot 21 and side portion 20, of pivot pin 8, in sliding contact with edge 51, of rectangular slot 26, a three point contact is established between pivot pin 8 and actuator housing 10. Therefore as pivotal switch element 6 pivots and slides, within slidable slot 9, in reaction to the contact of door actuators 5, during opening and closing of doors 2 and 3, and the opposing abutting force of biased micro-switch actuator 11, on pivot pin 8, the three point contact guides the movement of pivot pin 8 and pivotal switch element 6, within slot 9, to prevent any cocking or jamming of pivot pin 8 and pivotal switch element 6, during such movement. In addition, since both surface 50 and surface 24, see FIG. 6, of pivot pin 8, are flat and in the same plane as edges 28 and 25, of rectangular slots 26 and 21, see FIGS. 13 and 14, when pivot pin 8 is mounted within rectangular slots 26 and 21, perpendicular alignment of pivot pin 8, within slidable slot 9, see FIG. 3, is assured. By assuring perpendicular alignment of pivot pin 8, aligning and securing of pivotal switch element 6, by pivot pin 8, in slidable slot 9, for smooth and non-jamming operation is assured and easily accomplished.

When pivotal switch element 6 is in its first position, as shown by solid lines in FIGS. 1 and 2, cylindrical surface 12, of pivot pin 8, is biased, by micro-switch actuator 11, away from actuator housing base 38, as shown in FIG. 3, and a top surface 44 and a bottom surface 43, of cylindrical surface 12, as shown in FIG. 6, are adjacent, but not in contact with internal surfaces 42 of slidable slot 9. However, since surface 44 is adjacent and below lip 29 of internal surface 42 and surface 43 is adjacent and above lip 30 of internal surface 42 and both surfaces 42 and 43 are retained in these positions by the abutting contact between pivot pin 8 and biased micro-switch actuator 11, surface 44 prevents any upward movement of pivot pin 8, in slidable slot 9, and surface 43 prevents any downward movement of pivot pin 8, in slidable slot 9, that could dislodge pivot pin 8 from slidable slot 9. To prevent pivot pin 8 from dislodging itself during pivotal and slidable movement of pivotal switch element 6, within actuator housing 10, a surface 47 of mounting bracket 14 is provided. While surface 47 does not make contact with rectangular portion 27, of pivot pin 8, nor interfere with normal travel of pivot pin 8, it is adjacent to and under the path of travel of rectangular portion 27, of pivot pin 8. This prevents pivot pin 8 from moving downward, in actuator housing 10, to a point where it could dislodge itself from actuator housing 10. In addition, since shoulder 22 is in abutting contact with surface 23 of micro-switch actuator 11, pivot pin 8 is precluded from any upward travel within actuator housing 10 that could dislodge pivot pin 8.

As shown in FIG. 3, micro-switch actuator 11 is secured to a light switch activator shaft 33, which is in bias sliding contact with an apparatus activator shaft 34. Apparatus activator shaft 34, in turn, is in bias slidable contact with micro-switch 39. In other words, light switch activator shaft 33 slides within apparatus activator shaft 34 and apparatus activator shaft 34 slides within micro-switch 39 so that when light switch activator shaft 33 slides into apparatus activator shaft 34 a set distance, it activates a certain portion of micro-switch 39 that is connected to a light circuit which activation turns on the light. Also, as apparatus activator shaft 34 slides into micro-switch 39 a set distance, it activates a certain portion of micro-switch 39 which is connected to a circuit for enabling and disabling the electric circuit of the reproduction apparatus. The biasing means for light switch activator shaft 33, apparatus activator shaft 34 and that of micro-switch actuator 11, as previously mentioned, is by means associated with microswitch 39, which is known in the art, but not shown. Therefore as either end 35 or 36 of pivotal switch element 6 is pivoted about cylindrical surface 12, of pivot pin 8, by contact with actuator 5 of either door 2 or door 3, end 35 or 36, whichever end is not in contact with actuator 5, will pivot until it contacts an inside surface 37 of striker plate 19, see dotted line portrayal in FIG. 2. When contact is made, with inside surface 37, this precludes further pivotal movement of switch element 6, in that direction. Any further closing, of the door that caused said pivotal motion, will therefore only impart slidable movement to pivotal switch element 6, within slidable slot 9. This slidable movement, of pivotal switch element 6, which is imparted to pivotal pin 8, overcomes the biasing force placed on light switch activator shaft 33, by micro-switch 39, and light switch activator shaft 33, due to the abutting force of pivot pin 8 on micro-switch actuator 11, slides into apparatus activator shaft 34. This results in the engagement of the second positional station of micro-switch 39. Upon engagement of the second positional station of microswitch 39, a first current path through micro-switch 39 is established and a light is activated, on cabinet 1, indicating that one door, of cabinet 1, is still open.

While each actuator 5, of doors 2 and 3, is individually of sufficient length to cause engagement of the second positional station of micro-switch 39, as heretofore described, neither actuator 5, on its own, can cause engagement of the third positional station of micro-switch 39. However, when the second door, of cabinet 1, is closed, then activator 5, for that door, contacts end 35 or 36, whichever end is in contact with inside surface 37, of striker plate 19, to both pivot pivotal switch element 6, opposite to its prior pivotal motion, and slide it toward actuator housing base 38. This pivoting and sliding motion of pivotal switch element 6 toward actuator housing base 38, with said sliding motion being imparted to pivotal pin 8, overcomes the biasing force placed upon light switch activator shaft 33, by micro-switch 39, and slides, due to the abutting force of pivot pin 8 on micro-switch actuator 11, light switch activator shaft 33 further into apparatus activator shaft 34 causing apparatus activator shaft 34 to slide, against the biasing force of micro-switch 39, into micro-switch 39. Once apparatus activator shaft 34 slides into micro-switch 39, the third positional station of micro-switch 39 is engaged, the first current path is broken extinguishing the door open light and a second current path is established through micro-switch 39 allowing current to flow to the electrical components contained in cabinet 1 upon the activation of a start button, not shown, but known in the art. Upon the opening of door 2 or door 3 or both, the above is reversed, since the biasing force exerted by micro-switch 39, returns micro-switch 39 to its second or first positional station as the opening of doors 2 and 3 cause actuators 5 to pivot away from their influential contact with pivotal switch element 6.

In operation, if an operator walks up to cabinet 1, of the reproduction apparatus, and either door 2 or door 3 or both are open, pivotal switch element 6 will be in one of the positions illustrated in FIG. 1 and the reproduction apparatus will not operate. The operator will then, if said operator wishes to operate the reproduction apparatus, and both doors are open, either pivot door 2 or door 3 about pivots 4 to close said door. As door 2 or door 3 is pivoted toward its closed position, actuator 5, of that door, will approach and enter slot 45, of striker plate 19, and make contact with either end 35 or end 36 of pivotal switch element 6. Upon making contact with either end 35 or end 36, and with the continuation of the closing of said door, actuator 5, of that door, will cause pivotal switch element 6 to continually pivot until it reaches the position shown in dotted lines in FIG. 2, if door 3 had been closed, or in the reverse position, if door 2 had been closed. When said dotted line position is reached, pivoting of pivotal switch element 6 ceases and slidable movement of pivotal switch element 6 begins and continues until the door is completely closed and secured by magnet 46, to cabinet 1. This sliding motion causes light switch activator shaft 33 to slide, due to the abutting force of pivot pin 8 on micro-switch actuator 11, into apparatus activator shaft 34, against the biasing force of micro-switch 39, and engage the second positional station of micro-switch 39. Upon engagement of the second positional station of micro-switch 39, a light, on the reproduction apparatus, not shown, but known in the art, is activated to indicate that one door is still open.

Upon the operator seeing the light indicating that one door is still open, the operator proceeds to close the second door. During said closing, actuator 5, of that door, passes through slot 45 of striker plate 19 and makes contact with end 35 or end 36, whichever end is in contact with inside surface 37 of striker plate 19. This causes pivotal switch element 6 to pivot about pivot pin 8, in a direction opposite to which it had pivoted, and light switch activator shaft 33 to slide, due to the abutting force of pivot pin 8 on micro-switch actuator 11, further into activator shaft 34. Further closing of the second door causes apparatus activator shaft 34 to slide, again due to the abutting force of pivot pin 8 on micro-switch actuator 11, into micro-switch 39, which sliding continues until the door is completely closed and activator shaft 34 has moved to the point where the third positional station of micro-switch 39 is engaged. At this point, the circuit for providing current to the door open light is broken and a circuit for providing current to the reproduction apparatus is completed rendering the reproduction apparatus ready for operation. Upon the opening of door 2 or door 3 or both, the above is reversed, since the biasing force exerted by micro-switch 39, returns micro-switch 39 to its second or first positional station as the opening of doors 2 and 3 cause door actuators 5 to pivot away from their influential contact with pivotable switch element 6.

While the invention has been described in detail with particular reference to a preferred embodiment thereof, it will be understood that variations and modifications can be effected within the spirit and scope of the invention.

I claim:

1. A multiple interface safety switch actuating mechanism, operable by door actuators of a double door cabinet, for moving a normally biased open shaft activated switch mechanism between its positional stations, as the doors of the cabinet are opened and closed, to control activation of an apparatus contained within the cabinet, the switch actuating mechanism comprising:

a cabinet mount housing;

an actuator housing mounted with the cabinet mount housing;

pivotal and slidable means mounted in the actuator housing for pivotal and slidable movement;

mounting means for mounting the pivotal and slidable means for pivotal and slidable movement in the actuator housing and for activating and deactivating the positional stations of the switch mechanism in response to the pivotal and slidable movement of the pivotal and slidable means;

fixed guide means for guiding the movement of the mounting means within the actuator housing as the mounting means reacts to the movement of the pivotal and slidable means; and reception means for receiving the door actuators that impart and control pivotal and sliding movement of the pivotal and slidable means as the cabinet doors are opened and closed.

2. The switch actuating mechanism of claim 1 wherein the pivotal and sliding means is maintained in:

a first position when both doors of the cabinet are open for preventing activation of the apparatus contained within the cabinet;

a second position when one door of the cabinet is closed for preventing activation of the apparatus contained within the cabinet and indicating a door of the cabinet is open; and a third position when the doors of the cabinet are closed for allowing operation of the apparatus contained in the cabinet.

3. The switch actuating mechanism of claim 1 wherein the cabinet mount housing includes a plate having the reception means and door securing means, mounted between the pivotal and slidable means and the cabinet door actuators.

4. The switch actuating mechanism of claim 3 wherein the reception means are arranged for the door actuators to pass through the reception means, of the plate, for engagement and disengagement with the pivotal and slidable means.

5. The switch actuating mechanism of claim 1 wherein the guide means includes:

edges of the actuator housing; and a pivot pin for maintaining contact with at least three of the edges of the actuator housing.

6. The switch actuating mechanism of claim 5 wherein the pivotal and slidable means includes:

a pivotal switch element, and a retainer housing, within the pivotal switch element, for mounting the pivotal switch element about the pivot pin.

7. The switch actuating mechanism of claim 6 wherein the pivot pin includes:

a rectangular portion for contacting and sliding along the first edge and the second edge of the actuator housing;

a side portion for contacting and sliding along the third edge of the actuator housing;

a cylindrical surface for pivotally mounting the pivotal switch element; and surfaces for preventing dislodgement of the pivot pin from the actuator housing.

* * * * *